US007032794B1

(12) United States Patent
Hung et al.

(10) Patent No.: US 7,032,794 B1
(45) Date of Patent: Apr. 25, 2006

(54) SAFETY DEVICE FOR PREVENTING A NAILER FROM DRY FIRING

(75) Inventors: Sunking Hung, Taichung (TW); Li-Hsin Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/978,060

(22) Filed: Oct. 28, 2004

(51) Int. Cl.
*B25C 1/04* (2006.01)

(52) U.S. Cl. ..... 227/8; 227/120

(58) Field of Classification Search ..... 227/8, 227/130, 120, 136
See application file for complete search history.

(56) References Cited

U.S. PATENT DOCUMENTS 4,597,517 A * 7/1986 Wagdy ..... 227/8
5,816,468 A * 10/1998 Yang ..... 227/8
6,199,739 B1 * 3/2001 Mukoyama et al. ..... 227/8
6,209,770 B1 * 4/2001 Perra ..... 227/8
6,431,429 B1 * 8/2002 Canlas et al. ..... 227/130
6,908,021 B1 * 6/2005 Wang ..... 227/8
6,913,179 B1 * 7/2005 Chen ..... 227/8
6,938,809 B1 * 9/2005 Schnell ..... 227/8

* cited by examiner

*Primary Examiner*—Scott A. Smith
(74) *Attorney, Agent, or Firm*—Charles E. Baxley

(57) ABSTRACT

The present invention relates to a safety device for preventing a nailer from dry firing, wherein an elongated hole is formed on the magazine, the safety link is provided with a folded projection in response to the elongated hole, a safety nut is pivotally disposed in the elongated hole. The magazine is provided with an elastic element for keeping the safety nut flush with the edge of the elongated hole. After the last nail is shot (when no nails are loaded), the safety nut will be pushed out of the elongated hole by the drive plate so as to prevent the nailer from being fired. Thus, the user's strength and energy are saved, meanwhile, the service life of the nailer is prolonged.

4 Claims, 4 Drawing Sheets

SAFETY DEVICE FOR PREVENTING A NAILER FROM DRY FIRING

BACKGROUND OF THE INVENTION

1. Field of the Invention

The present invention relates to a nailer, and more particularly to a safety device for preventing a nailer from dry firing.

2. Description of the Prior Arts

Most of the conventional nailers are provided with a safety device, however, the safety device only can ensure the safety of the user during nailing course (prevent the nails from being accidentally shot by mistake), but it is unable to stop the nailer from dry firing when no nails are loaded. Thus, there are still some problems will be caused:

First, the user can realize the nails are exhausted only after holding the nailer, aiming at the object and pressing the trigger, this will be a drain on the user's strength and energy.

Second, when the nailer is dry fired in case no nails are loaded, the components inside the nailer will be subjected to a strong impact (because no nail provides a buffering effect), thereby, the service life of the conventional nailer will be shortened.

It is to be noted that there is a safety device on market which can be used to prevent the nailer from dry firing. The drive plate of this safety device projects out of the magazine to stop the safety link, however, if the user presses the safety link without knowing no nails are loaded in the magazine, the press force applied by the user will be acted on the drive plate, causing deformation of the drive plate. Thus, not only the dry firing cannot be prevented, but also the nails will be jammed because of the drive plate deformation.

The present invention has arisen to mitigate and/or obviate the afore-described disadvantages.

SUMMARY OF THE INVENTION

The primary objective of the present invention is to provide a safety device for preventing a nailer from dry firing, wherein an elongated hole is formed on the magazine, the safety link is provided with a folded projection in response to the elongated hole, a safety nut is pivotally disposed in the elongated hole. The magazine is provided with an elastic element for keeping the safety nut flush with the edge of the elongated hole. After the last nail is shot (when no nails are loaded), the safety nut will be pushed out of the elongated hole by the drive plate so as to prevent the nailer from being fired. Thus, the user's strength and energy are saved.

The secondary objective of the present invention is to provide a safety device for preventing a nailer from dry firing, which can make the safety nut project out of the elongated hole to stop the movement of the folded projection of the safety link by using a leverage, thereby preventing the nailer from strong impact when no nails are loaded, meanwhile, the service life of the nailer is prolonged.

The further objective of the present invention is to provide a safety device for preventing a nailer from dry firing, wherein the drive plate is used to push against the safety nut, and then the safety nut is used to stop the movement of the folded projection of the safety link. Thus, the deformation of the drive plate can be prevented. Moreover, the contact area between the safety nut and the safety link is big enough, thereby, the service life of the relative components is increased.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
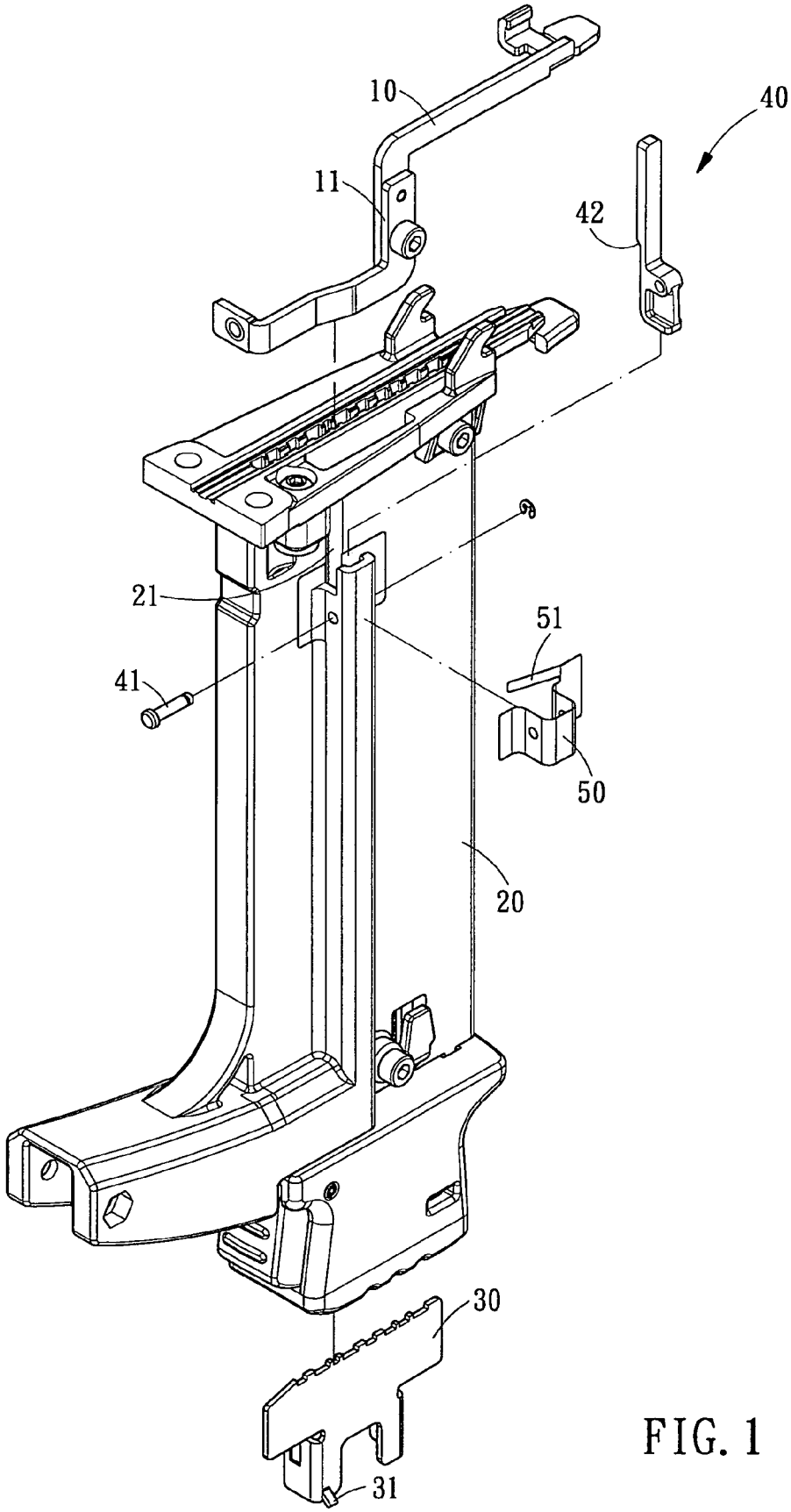
FIG. 1 is an exploded view of a safety device for preventing a nailer from dry firing in accordance with the present invention.
Figure 2:
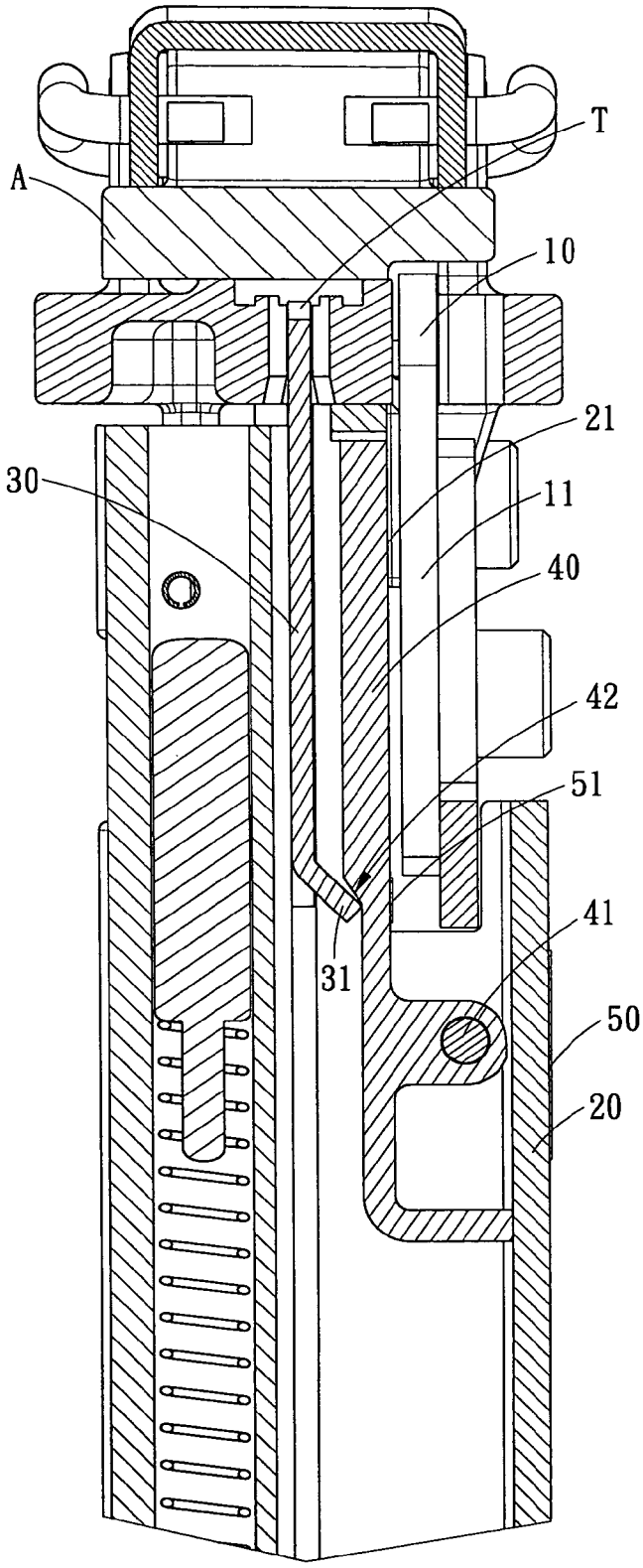
FIG. 2 is a cross sectional view of showing the safety device in accordance with the present invention when nails are loaded.

Referring to FIGS. 1 and 2, a safety device for preventing a nailer from dry firing in accordance with the present invention is shown and comprises the following components:

A safety link 10 is fixed to the front end of a nailer A and is able to move back and forth repeatedly according to needs, at the mid portion of the safety link 10 is provided a folded projection 11.

A magazine 20 is installed at the front end of the nailer A, at a side of the magazine 20 is defined an elongated hole 21 whose upper portion corresponds to the folded projection 11 of the safety link 10.

A drive plate 30 is slidably disposed in the magazine 20 to push the nails T by cooperating with a spring. The drive plate 30 is provided with a projection 31 which is moveably disposed in the elongated hole 21 of the magazine 20.

A safety nut 40 is pivotally disposed at the edge of the elongated hole 21 of the magazine 20 by a fastener 41, an upper end of the safety nut 40 serves to stop the movement of the folded projection 11 of the safety link 10. The safety nut 40 is provided with a bevel surface 42 in response to the projection 31 of the drive plate 30, and the projection 31 will push against the bevel surface 42 when no nails T are loaded. Thus, the safety nut 40 can act as a leverage while the fastener 41 serving as a fulcrum. At this moment, an end of the safety nut 40 will project out of the elongated hole 21 of the magazine 20.

An elastic element 50 is disposed at the edge of the elongated hole 21 of the magazine 20 by the fastener 41, and an elastic plate 51 of the elastic element 50 extends into the elongated hole 21 to push against the safety nut 40 so as to keep the safety nut 40 flush with the edge of the elongated hole 21 of the magazine 20.

As shown in FIG. 2, when the nails T are loaded in the magazine (the drive plate 30 will push against the nails T), the projection 31 of the drive 30 doesn't reach the predetermined position, so the projection 31 will not push against the bevel surface 42 of the safety nut 40. And meanwhile, the elastic plate 51 of the elastic element 50 will keep the safety nut 40 flush with the edge of the elongated hole 21 of the magazine 20. Thereby, the safety link 10 is able to move back and forth at this moment, and the nails T can be shot.

Figure 3:
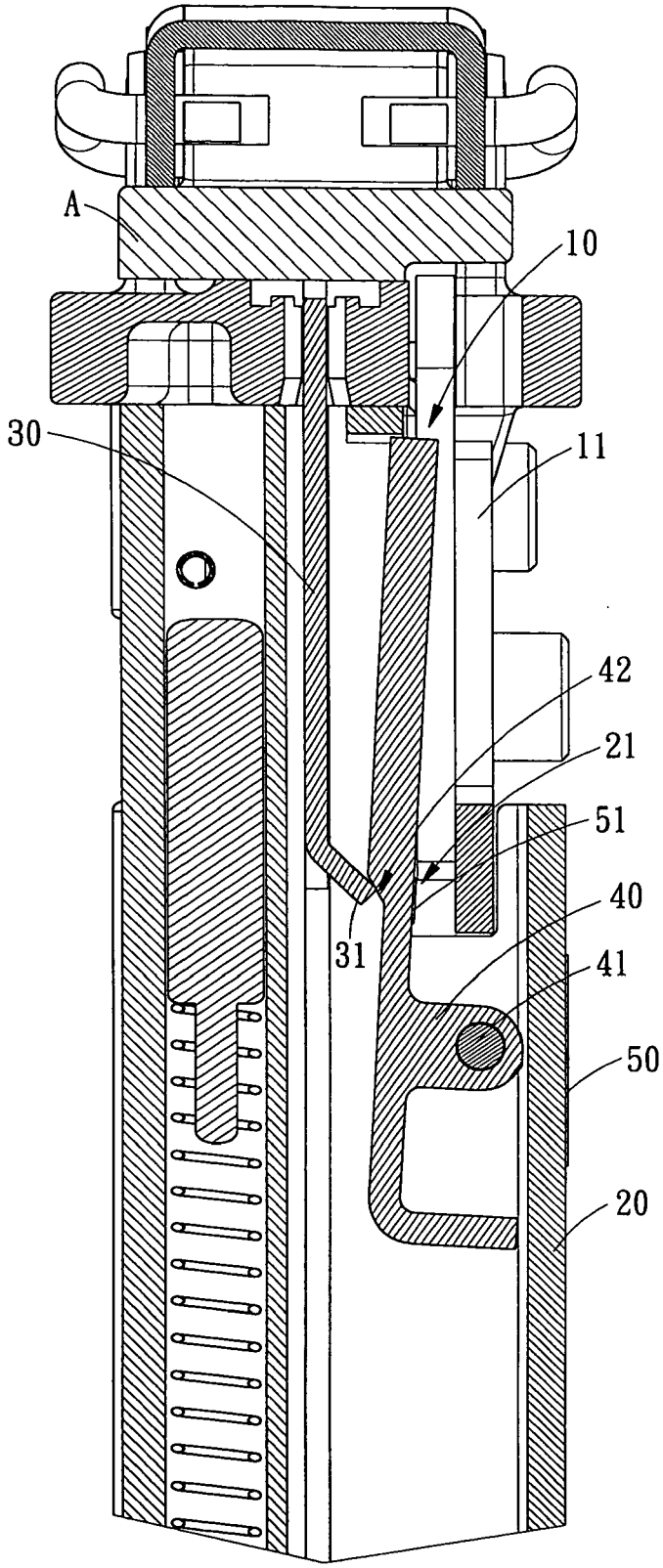
FIG. 3 is a cross sectional view of showing the safety device in accordance with the present invention when no nails are loaded.
Figure 4:
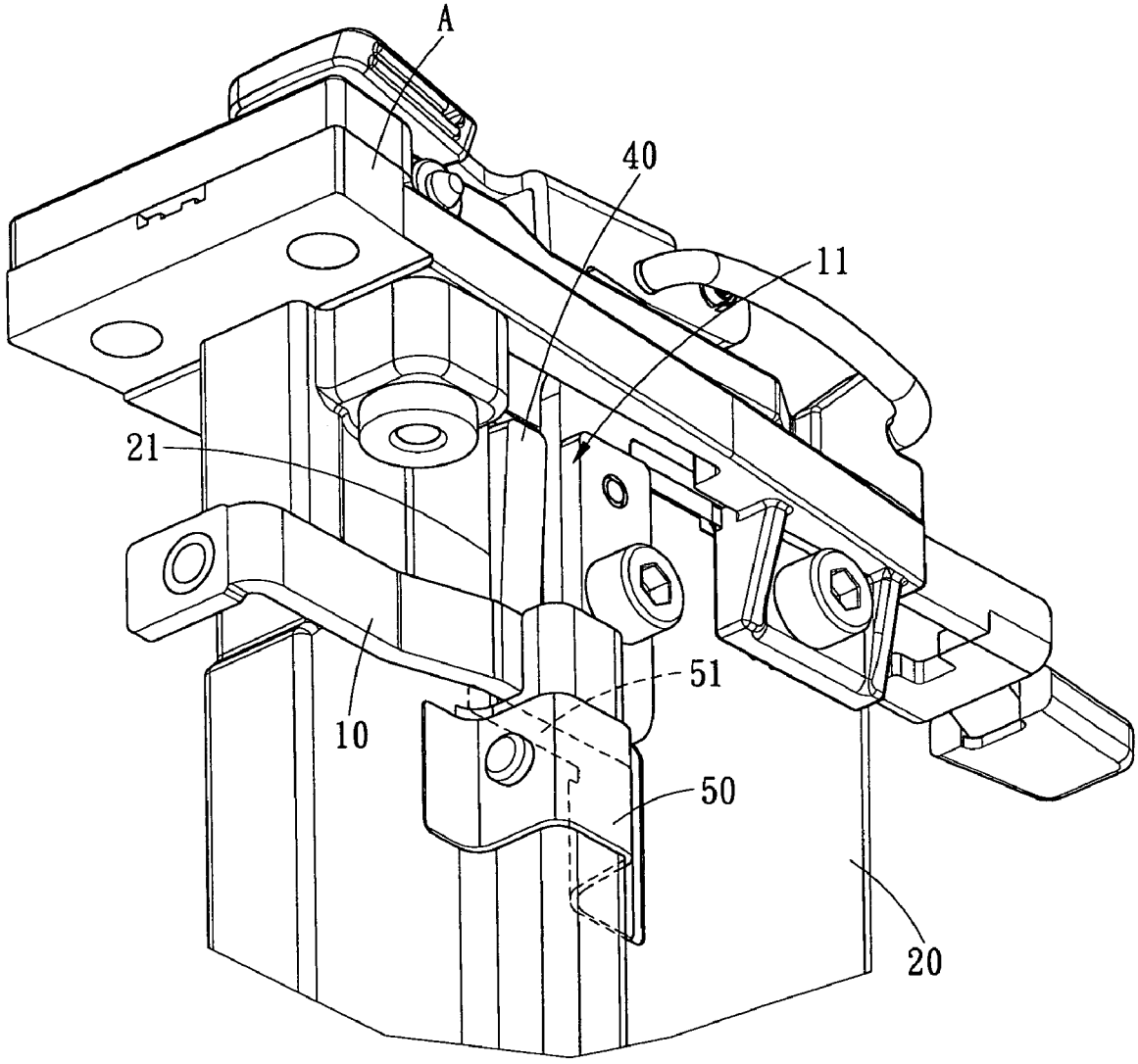
FIG. 4 is a perspective view of showing the safety device in accordance with the present invention when nails are loaded.

With reference to FIGS. 3 and 4, when no nails T are loaded, the drive plate 30 is pushed to the top end of the magazine by the spring, at this moment, the projection 31 of the drive plate 30 will push against the bevel surface 42 of the safety nut 40. And then the safety nut will produce a leverage effect by using the fastener 41 as a fulcrum, so that the upper end of the safety nut 40 will project out of the elongated hole 21 of the magazine 20 to stop the movement of the projection 11 of the safety link 10. That is to say, when no nails T are loaded, the safety link 10 will be stopped and cannot be pressed down, thereby, the nailer cannot be fired when no nails are loaded.

In addition, by using the safety nut 40 and the safety link 10, the deformation of the drive plate 30 can be eliminated.

While we have shown and described various embodiments in accordance with the present invention, it should be clear to those skilled in the art that further embodiments may be made without departing from the scope of the present invention.

What is claimed is:

1. A safety device for preventing a nailer from dry firing, comprising:

a safety link being fixed to a front end of a nailer and able to move back and forth thereon;

a magazine installed at the front end of the nailer, at a side of the magazine defined an elongated hole whose upper portion corresponds to a folded projection of the safety link;

a drive plate slidably disposed in the magazine to push nails by cooperating with a spring, the drive plate provided with a projection which being moveably disposed in the elongated hole of the magazine;

a safety nut pivotally disposed beside the elongated hole of the magazine and provided with a bevel surface in response to the projection of the drive plate, wherein the projection of the drive plate will push against the bevel surface of the safety nut when no nails are loaded in the magazine, thus, the safety nut produces a leverage effect by taking advantage of the bevel surface, so as to make an end of the safety nut project out of the elongated hole of the magazine;

an elastic element disposed at the edge of the elongated hole of the magazine and employed to push against the safety nut so as to keep the safety nut flush with the edge of the elongated hole of the magazine.

2. The safety device for preventing a nailer from dry firing as claimed in claim 1, wherein safety nut is pivotally disposed beside the elongated hole of the magazine by a fastener.

3. The safety device for preventing a nailer from dry firing as claimed in claim 2, wherein the elastic element is disposed at the edge of the elongated hole of the magazine by the fastener, and an elastic plate of the elastic element extends into the elongated hole to push against the safety nut.

4. The safety device for preventing a nailer from dry firing as claimed in claim 1, wherein a folded projection is provided at a mid portion of the safety link, and an upper end of the safety nut serves to stop the movement of the folded projection of the safety link.

* * * * *